United States Patent [19]

Stancil

[11] Patent Number: 4,656,945

[45] Date of Patent: Apr. 14, 1987

[54] HELICOPTER DESTRUCTION SYSTEM EMPLOYING CABLES

[76] Inventor: Charles M. Stancil, 6661 Green Ash Dr., Springfield, Va. 22151

[21] Appl. No.: 714,205

[22] Filed: Mar. 21, 1985

[51] Int. Cl.[4] ..... F42B 13/56

[52] U.S. Cl. ..... 102/405; 89/1.11; 102/504

[58] Field of Search ..... 102/405, 504; 89/1.11

[56] References Cited

U.S. PATENT DOCUMENTS

| | | | |
|---|---|---|---|
| 1,309,530 | 7/1919 | Lamberson | 102/504 |
| 2,374,261 | 4/1945 | Ames | 102/405 |
| 2,805,622 | 9/1957 | Cammin-Christy | 102/504 |
| 4,067,340 | 1/1978 | Le Noir | 128/305 |
| 4,294,157 | 10/1981 | Stancil | 102/504 |
| 4,327,644 | 5/1982 | Stancil | 102/504 |

*Primary Examiner*—Charles T. Jordan

*Attorney, Agent, or Firm*—Hall, Myers & Rose

[57] ABSTRACT

A method and apparatus for destroying helicopters is disclosed and relies on launching cables above a helicopter which cables are tailored to a specific helicopter to maximize the probability of ingestion of the cable into the helicopter rotor system thus providing a low cost, highly efficient helicopter destruction system.

7 Claims, 5 Drawing Figures

HELICOPTER DESTRUCTION SYSTEM EMPLOYING CABLES

BACKGROUND OF THE INVENTION

1. Field of the Invention

The present invention relates to methods and apparatus for destroying helicopters and more particularly to devices and methods for launching cables into the airspace around and particularly above attacking helicopters for ingestion of the cable into the helicopter rotor system; the cables being defined each for use against a specific type or make of vehicle thereby to increase their effectiveness and thus enhance the probability of kill.

2. Description of the Prior Art

Numerous patents are found in the prior art dealing with launch systems for cables, wires and the like intended to be ingested into and destroy the main rotor and/or tail rotors of a helicopter or at the minimum to disrupt controlled flight. There are multiple effects that can be produced by ingestion of a cable into the rotor system of a helicopter. The most obvious and most effective is to prevent rotation of or to produce destruction of the blades. Other highly effective results are loss of control functions due to destruction of the rotor control mechanisms or to increasing the apparent load on the main rotor which causes the destabilization of the heading control from the thrust of the tail rotor to thereby destabilize coordinated flight of the craft. It is also apparent that damage to or destruction of the tail rotor can produce disastrous results. When considering the fact that attack helicopters and personnel transport helicopters operate quite close to the ground, even a relatively temporary loss of control can produce a destructive impact with the ground. Additionally, the whipping cables will often contact personnel disembarking from the vehicles with equally destructive effects.

In my prior U.S. Pat. Nos. 4,294,157 and 4,327,644, there are described systems for launching cables and include the use of cables wound into donuts and connected to a mechanism which is picked up by a rocket or shell launched by conventional means.

The advantage to a cable system against helicopters is that an entire landing area can be blanketed with cables quickly and relatively inexpensively. Currently used helicopter defense systems attempt to strike the craft, each round being directed against a specific targeted craft. The cost of each such round is from $10,000 to $40,000 or more and such systems are not wholly effective, in fact, are relatively ineffective. On the other hand, firing of relatively inexpensive mortar rounds, rockets or artillery shells to provide a rectangular matrix of falling cables above a landing zone defines a highly efficient system of defense at costs competitive with the cost of just a few rounds of heat seeking or computer guided missiles. Launch vehicles for cables fall in the $1000 range as opposed to the $10,000 to $40,000 range for missiles and the like.

A basic problem with the cable systems proposed in the prior art is that each type of helicopter has a different air flow pattern around it and a cable that may be excellent for use against one type of craft may be quite inappropriate for another type of craft resulting in system efficiencies greatly below theoretical efficiences.

Further, the method of deploying the cables as proposed in the prior art are not highly cost efficient.

SUMMARY OF THE INVENTION

The present invention develops for each type of helicopter a cable length, diameter and density that is most effective against that specific helicopter. More specifically, the invention contemplates developing a set of equations that permits the defining of a cable that is most efficient in attacking each specific helicopter, developing such a cable and matching that cable to an available rocket, mortar, artillery shell or other appropriate projectile for delivery of each specific cable. The invention further contemplates specific ordnance developed in accordance with such concepts.

The present invention is based on the theory that in order to develop a system with a high attack efficiency, the cable must be designed to be accommodated to the air flow entering the helicopter rotor system from above and not rely primarily on gravity feed of the cable. By causing appropriate interaction between the cable and the downward air flow generated by the helicopter rotor, the probability of the cable being ingested into the rotor system is greatly enhanced. The appropriately designed entanglement will permit two modes of attack. The primary mode would be an automatic delivery of entanglement munitions during the landing/attack phase of the helicopter operation. The second mode of employment also relates to the air flow generated by the helicopter rotor flows interacting with the ground. This interaction in the presence of an appropriately designed entanglement deployed prior to landing/attack will create an ingestion phenomena that will allow the munition to be deployed prior to the helicopter assault and attrit the target aircraft as a barrier system.

The structure of the cable and the material is also important. It has been found that PHILLYSTRAN TM, a continuous filament fiber strand and rope that uses KEVLAR TM, a Du Pont product comprising an aramid fiber impregnated with a proprietary flexible polyurethane resin system, is particularly effective. PHILLYSTRAN is a completely flexible rope having a strength-to-weight ratio approximately 5 times that of steel in air and 10 times that of steel in water. Various PHILLYSTRAN compositions are available using the various formulations of KEVLAR.

PHILLYSTRAN 29 and 49 for instance, have the following characteristics:

TABLE 1

| TYPICAL PROPERTIES | PHILLYSTRAN 29 | PHILLYSTRAN 49 |
|---|---|---|
| Tensile Strength | 300,000 psi (A) | 280,000 psi (B) |
| Elongation at Break | 3.4% (A) | 2.2% (B) |
| Modulus of Elasticity | $9.5 \times 10^6$ psi (A) | $14 \times 10^6$ psi (B) |
| Specific Gravity | 1.3 | 1.3 |
| Water Absorption | less than 1% | less than 1% |
| Continuous operation | −70° F. to +165° F. | |
| Short term exposure | up to 500° F. | |

Typical PHILLYSTRAN cables are as follows:

TABLE 2

| | NOMINAL DIAMETER OF BARE ROPE | | APPROX. BREAK STRENGTH | | APPROX. WEIGHT OF BARE ROPE LBS./ | |
|---|---|---|---|---|---|---|
| | IN. | MM. | LBS. | KG | 1000 ft. | KG/KM |
| PS29-S-59 | .07 | 1.8 | 400 | 180 | 1.2 | 1.8 |
| PS29-S-16 | .09 | 2.3 | 800 | 360 | 2.3 | 3.5 |
| PS29-S-48 | .10 | 2.5 | 1,200 | 540 | 3.5 | 5.3 |
| PS29-S-75 | .13 | 3.3 | 2,000 | 900 | 6.0 | 9.0 |
| PS29-S-72 | .21 | 5.3 | 4,500 | 2,000 | 12.0 | 18.0 |
| PS29-S-146 | .28 | 7.1 | 7,000 | 3,175 | 22.0 | 32.7 |

It is noted that 1000 feet of the strongest cable listed weighs only 95 pounds. Thus, a 250 ft. cable, a length of cable used for defense against a specific helicopter, weighs only 19 pounds and may readily be deployed even by relatively low energy mortar or artillery shells or rockets.

A further important fact that permits the present system to be fully effective is the ability to determine the helicopter or helicopters in an attack group before they are seen and well before they arrive at the attack sight. The audible beat frequency developed between the main and tail rotors of each helicopter is unique to that craft so that in effect the helicopters "sign in" well before arrival. Thus, in accordance with the present invention, the launch vehicles carrying the cables tailored to the helicopters in "the attack group" may be loaded and ready for firing well before the craft are over the attack site. Also a matrix of appropriate cables can be deployed along the ground for ingestion into the rotors of helicopters when they land. By these features of employment, that is, the sign-in feature, friendly aircraft can be immediately recognized and not subject to attack.

Thus, one aspect of the present invention is the provision of cables tailored to various of the helicopters in use throughout the world at any given time. Another aspect of the invention is the method by which helicopters in an attack group are identified and cables, selected for maximum kill rate efficiency, are launched above the vehicles of the attack group and/or along the ground to cause ingestion thereof by the helicopter rotor systems.

DETAILED DESCRIPTION OF THE PREFERRED EMBODIMENTS OF THE PRESENT INVENTION

Figure 1:
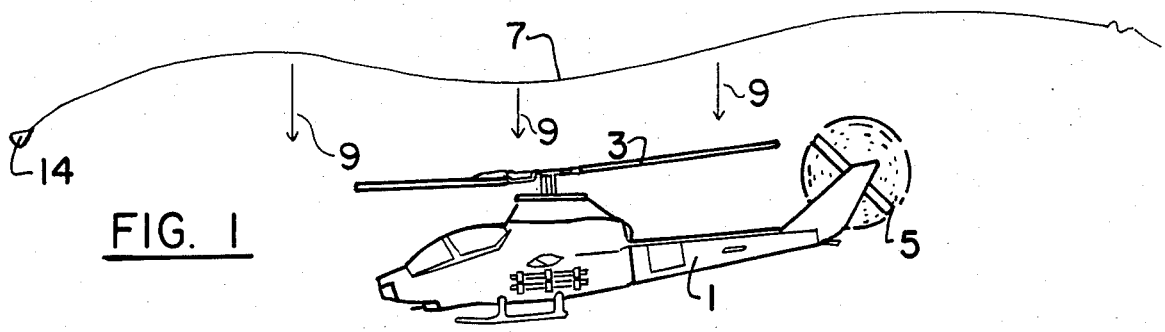
FIG. 1 is an illustration of a cable in accordance with the present invention deployed above a helicopter.

Referring now specifically to FIG. 1 of the accompanying drawings, there is illustrated a helicopter 1 with main rotor 3 and a tail rotor 5. A cable 7 is illustrated as deployed above the helicopter.

A key factor in the ingestion phenomena employed to advantage in the present invention is the down flow of air or "down wash" developed by the rotor 3 and illustrated by arrows 9 in FIG. 1. In the following equations, $V_z$ is the rotor induced downward velocity of air. $V_z$ is at a maximum at the rotor tips when hovering but this may change in forward flight. The following equation may be used to determine $V_z$:

$$V_z = \sqrt{\frac{T}{2\rho \text{air} \pi R^2}} \tag{1}$$

where T is the thrust of the main rotor, $\rho$ air is the density of air and R is the radius of the rotor. The value of T is equal to the weight of the craft when hovering or in level flight since in those situations the downward thrust exactly balances the weight of the craft.

Having determined the value of $V_z$ for a specific helicopter (weight and rotor radius) the drag force on a cable situated above the rotor may be determined. The minimum useful threshhold of drag, which occurs at about twice the rotor diameter above the rotor, may be determined by equation:

$$D = C_D \times \tfrac{1}{2} \times \rho \text{ air} \times V_z^2 \times A \tag{2}$$

where D is drag, A is the area of the cable 7 exposed to the down wash from the rotor and $C_D$ is the coefficient of drag. (Assume $C_D = 1.0$). The area of the cable subject to the drag force is the diameter of the cable times some function of the length of the cable. Since the maximum force is usually developed over the outer one-third of the rotor blades, the length of cable subject to such force is chosen as (R/3) where R is the radius of the blade.

Substituting in Equation 2, D becomes $$D = \frac{\rho \text{air}}{2} C_D V_z^2 \left( \frac{R}{3} \times d_c \right) \tag{3}$$

where $d_c$ is the diameter of the cable and $C_D = 1$.

In order to be assured that the cable when ingested will be effective, the linear length should be twice the circumference of the main rotor system to allow for multiple wrap around of the rotor mast and a remaining length to engage the tail boom, tail rotor, exhaust stack and/or various other protrusions from the body of the vehicle. Thus, the length (L) of the cable is $$L = 4\pi R \tag{4}$$

To reflect the drag per unit length on the cable:

$$\frac{D}{L} = \frac{\frac{\rho \text{air}}{6} \times R \times V_z^2 d_c}{4\pi R} = \frac{\rho \text{air} \times V_z^2 d_c}{24\pi} \tag{5}$$

The expression for mass per unit length of the cable is $$\frac{M}{L} = \frac{\rho_c \times L}{L} \times \frac{\pi d_c^2}{4} \tag{6}$$

$$\frac{M}{L} = \frac{\pi}{4} \times \rho_c d_c^2$$

where $\rho_c$ is the density of the cable.

In order for ingestion to start, i.e. ingestion threshold, the drag force (D) must be greater than the mass (M) of the cable; that is $(D/M) \geqq 1$. Thus $$\frac{D}{M} \geqq \frac{\frac{\rho air\ V_z^2\ d_c}{24\pi R}}{\frac{\pi}{4} \times \rho_c\ d_c^2} \tag{7}$$

$$\frac{D}{M} \geqq \frac{\rho air \times V_z^2}{6\pi^2\ \rho_c\ d_c}$$

$$\frac{D}{M} \geqq 4.22 \times 10^{-5} \frac{V_z^2}{\rho_c\ d_c} \geqq 1$$

A plot of $\rho_c d_c$ against $V_z^2$ establishes a bounded region on a graph that delineates the values of $\rho_c\ d_c$ and $V_z$ that will support ingestion for each type of craft since $V_z$ is a function of the craft and $\rho_c\ d_c$ is a function of the cable. Specifically, $V_z$ is defined by each craft and is for each craft an invariable of the system. The factors $\rho_c$ and $d_c$ being functions of the cable they can be and are selected so that Equation 7 is satisfied for a particular cable to be used as defense against a specific craft or to insure that a number of different specified target aircraft will be within the effective range of the entanglement characteristics.

In order to determine $\rho_c$ and $d_c$ of the cable, the force per unit length to which the cable will be subjected upon encounter with the rotor blades of the craft must first be determined for each craft to ensure that the strength of the cable is not exceeded.

The change in kinetic energy to which the cable will be subjected is determined by the following equation:

$$F = ma = \frac{m(V_1^2 - V_2^2)}{2s} \tag{8}$$

where s is the distance through which the cable is subject to acceleration. Since the velocity of the cable in the direction in which it is to be accelerated is initially zero, Equation 8 becomes:

$$F=(mV_2^2/2s) \tag{9}$$

The mass of the cable M, can be expressed as the product of the density, $\rho_c$ cross-sectional area $\pi d_c^2/4$ and the length, L, of the cable. The term "s" represents the portion of the circumference of the rotor sweep (circumference) over which the cable is accelerated, approximately 90°, and may be expressed in terms of the length L (as expressed in Equation (4) subjected to acceleration. Thus the cable is accelerated over a distance equal to approximately one-eighth of its length. Equation 9 becomes:

$$F = \frac{\pi \rho_c\ d_c^2\ V_2^2}{8} \tag{10}$$

Ultimately the critical stress that the cable must be capable of surviving must be evaluated based upon the target system dynamics ($V_2$) and the inertial characteristics of the selected material.

Equation 10 can be modified by multiplying both sides of the equation by one over the cross-sectional-area ($A_{cs}$) of the cable ($\pi d_c^2/4$):

$$\frac{F}{\frac{\pi d_c^2}{4}} = \frac{F}{A_c} = \frac{\rho_c\ V_2^2}{2} \tag{11}$$

To insure unit consistency, the right side of Equation 11 must reflect the quantity that one pound-force is equal to 32.2 pounds-mass-feet per second squared ($32.2^{lb}m^{-ft}/sec^2$).

Therefore Equation 11 can be written as:

$$\frac{F}{A_c} = \frac{\rho_c\ V_2^2}{64.4} \tag{12}$$

To demonstrate the application of the foregoing methodology, an example target aircraft is analyzed. The selected hypothetical target is chosen as the Mi-24 HIND helicopter. Descriptive data from Jane's "All The World's Aircraft" 1981–82 is as follows:

| | | |
|---|---|---|
| Gross Weight | 22,000 | pounds |
| Rotor Radius | 27.87 | feet |
| Rotor Blade Tip Speed | 703 | $\frac{ft}{sec}$ |

By assuming that the thrust of the main rotor system is equal to the gross weight of the HIND, $V_z$ (induced velocity) is found by equation $$V_z = \sqrt{\frac{T}{2\rho air \pi R^2}}\ ;\ \rho air = .0025\ \frac{slugs}{ft^3}$$

$$V_z = \sqrt{\frac{23000}{2\pi(.0025)(27.87)^2}}$$

$$V_z = 42.46\ \frac{ft}{sec}$$

With knowledge of the value of $V_z$ the prospective drag force in the air flowing down into the HIND rotor system may be calculated. Equation 2 is the generalized expression for drag (D):

$$D=\tfrac{1}{2}C_D \times \rho\ air\ V_z^2 \times A.$$

$C_D$ is equal to one and the exposed area of the cable is equal to the diameter times R divided by 3 as above.

$$D = \frac{\rho air}{6}\ (27.87)\ (42.46)^2 d_c\ \frac{slugs\text{-}ft}{sec^2}$$

$D=20.93\ d_c\ lbs_f$

As indicated above, it is necessary to compute the length of cable necessary for harmful effect. Cable length is given by $$L=4\pi(27.87)ft \tag{4}$$

$L=350.22$ ft

To find the drag expression in a per unit length basis as described above:

$$\frac{D}{L} = \frac{20.93\ d_c \text{lbs}_f}{350.22\ \text{ft}} = .05976\ d_c \text{lb}_f/\text{ft}$$

The expression for the mass per. unit length of the cable is given by Equation 6.

$$\frac{M}{L} = \frac{\pi}{4}\rho_c d_c^2 \tag{6}$$

The drag to mass (force) ratio is given by Equation 7.

$$\frac{D_L}{M_L} = \frac{.05976\ d_c}{\frac{\pi}{4}\rho_c d_c^2} = \frac{.07608}{\rho_c d_c}\ \frac{\text{lb}\cdot\text{ft}^2}{\text{slug}}$$

To insure that the cable will be ingested by the HIND rotor system the drag to mass ratio must be equal to or greater than one:

$$\frac{D}{M} = \frac{.07608}{\rho_c d_c} \geqq 1$$

Therefore:

$$\rho_c d_c \geqq .07608\ \frac{\text{lb}_f - \text{ft}^2}{\text{slug}}$$

This indicates that the critical diameter for the cable should be equal to the quantity 0.7608 ft divided by the density of the selected material (slugs/ft$^3$).

The other critical parameter, tensile strength, now enables the selection of the diameter of the cable d. From Equation 12, the tensile stress that the cable must withstand is given by:

$$\frac{F}{A_c} = \frac{\rho_c V_z^2}{2(32.2)} \times \frac{1728}{144}\ \frac{\text{lb}_f}{\text{ft}^2}$$

The factors 1728, 144, and 32.2 are necessary for unit consistency in order to state $F/A_c$ as pounds-force per square inch. In this manner $\rho_c$ may be stated in units of pounds-mass per cubic inch and velocity may be stated as feet per second.

Therefore for the Mi24 HIND:

$$(F/A_c) = \rho(703)^2(0.18633)$$

With knowledge of the following densities, $F/A_c$ can be calculated:

TABLE 3

| | KEVLAR | NYLON | DACRON POLYESTER | E-GLASS | STAINLESS STEEL |
|---|---|---|---|---|---|
| DENSITY (lbm/in$^3$) | 0.052 | 0.041 | .050 | .092 | .284 |
| $F/A_c$ (lbf/in$_2$) | 4,788.6 | 3,775.5 | 4,604.2 | 8,456.9 | 26,152.4 |

The analysis now focuses on specific design parameters. The tensile strength threshold was established by $F/A_c$. With knowledge of the threshold value for the various materials, a density may be selected from the materials listed in the above Table 3. Several examples are given:

$$\text{KEVLAR} - \text{density} = .052\ \text{lb}_m/\text{in}^3 \times \frac{\left(1728\ \frac{\text{in}^3}{\text{ft}^3}\right)}{32.2\ \text{lb/slug}}$$

$$d = \frac{.07608}{\rho_c}$$

$$d = \frac{.07608}{2.790} = .0272\ \text{ft} = .327\ \text{in}$$

Going back to the tensile stress threshold of 4,788.6 (lb$_f$/in$^2$)

$$A_{cs} = \frac{\pi(.327)^2}{4} = .0839\ \text{in}^2$$

The tensile stress threshold indicates a minimum break strength of 4,788.6 (lb$_f$/in$^2$)×0.0839 in$_2$=402 lb$_f$.

With the minimum break strength you may enter tabular data tables of materials; specifically see Table 2 above.

A specimen PS29-S-59 has a nominal diameter of 0.07 inches with a minimum break strength of 400 lbs. The weight for the specimen is 1.2 lb per 1000 ft.

From the calculation of L, L=4πR=350.22 ft. Therefore the weight of the cable would be $$3.5022\ \text{ft}\ \frac{1.2\ \text{lb}}{1000\ \text{ft}} = .42\ \text{lb}$$

Next a check is made to determine whether Equation 7 is satisfied, i.e. (D/M)≧1

$$D = \frac{.000042\ (42.46)_2}{2.79 \times \frac{.07\ \text{in}}{12}} = 4.6$$

which is >1.

Therefore the parameters of diameter and length with weight of cable have been identified for KEVLAR d=0.07 in.

L=350.22 ft wt=0.4 lb$_m$

It is recognized that there is a slight difference between the minimum break strength (402 lbs) and the specimen minimum break strength—400 lb. This is because of the tabular data being furnished in this increment. The point is adequately demonstrated, however, that the minimum break strength is the term employed to refer to tabular data on material properties for specific configuration.

Figure 2:
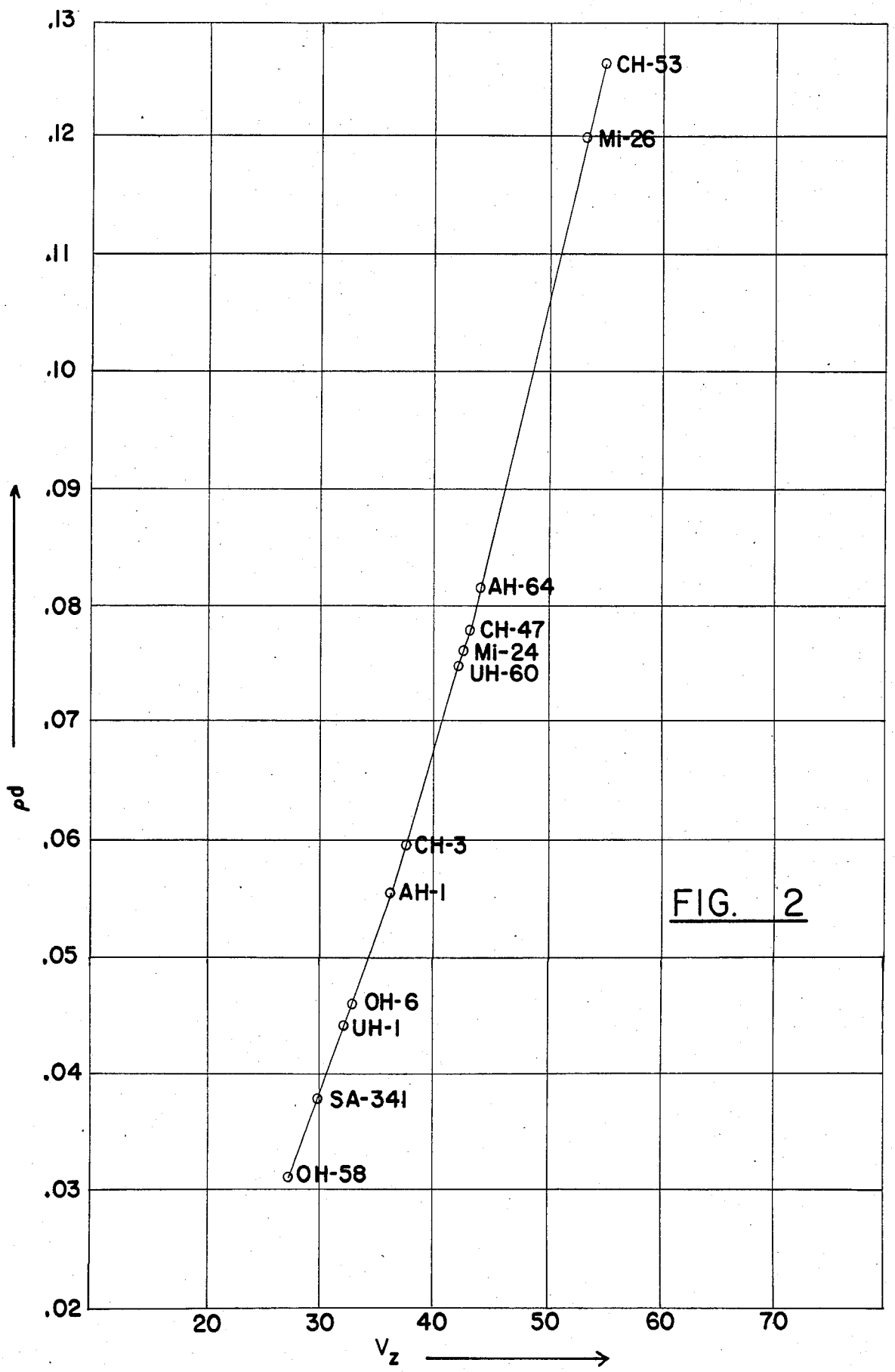
FIG. 2 is a graph illustrating the interdependence of the factor $V_z$ and the product $\rho d$.

Reference is now made to FIG. 2 of the accompanying drawing which is a plot of Equation 7, i.e.

$$\frac{D}{M} \geqq 4.22 \times 10^{-5}\ \frac{V_z^2}{\rho_c d_c} \geqq 1$$

ρd against $V_z$. A selection of a particular material must cause the resulting parameters to fall on the graph or to the right of it. The pull down force T, as indicated above must at least equal the weight of the craft and this parameter as well as the radius of the rotor blades are available from Janes or other sources. Thus from Equation 1 the value of $V_z$ of a craft under consideration can readily be determined and one can go to the plot of Equation 7, illustrated in FIG. 2, and immediately determine the value of the product $\rho d$.

It is noted that various letter-number designations are marked on the graph. These designations are the designations for various helicopters found in the aforesaid Janes publication. The parameters for these various craft necessary to calculate their placement on the graph of FIG. 2 are found in Table 4 below.

TABLE 4

JANE'S ALL THE WORLD'S AIRCRAFT 81-82

| AIR CRAFT | GROSS WEIGHT | ROTOR RADIUS (ft) | INDUCED VELOCITY $V_z$ ft/sec | PEAK INDUCED VELOCITY $V_{zp}$ | 2x D = 2C 4 R = 2C L |
|---|---|---|---|---|---|
| UH-1 | 9500 | 24.00 | 32.40 | 48.60 | 301.59 |
| AH-1 | 10000 | 22.00 | 36.26 | 54.39 | 276.46 |
| UH-60 | 20250 | 26.83 | 42.31 | 63.47 | 337.15 |
| AH-64 | 17650 | 24.00 | 44.17 | 66.26 | 301.59 |
| CH-3 | 21500 | 31.00 | 37.73 | 56.60 | 389.55 |
| CH-53 | 73500 | 39.50 | 54.76 | 82.14 | 496.37 |
| CH-47 | 53000 | 30.00 | 43.29 | 64.94 | 376.99 |
| CH-54 | | | | | |
| OH-58 | 3200 | 16.60 | 27.18 | 40.77 | 208.60 |
| OH-6 | 3000 | 13.19 | 33.13 | 49.70 | 165.75 |
| SA-341 | 4190 | 17.22 | 29.99 | 44.99 | 216.39 |
| SA-360 | 6614 | 18.86 | 34.40 | 51.60 | 237.00 |
| SA-365 | 7495 | 19.16 | 36.05 | 54.08 | 240.77 |
| SA-332 | 19840 | 24.73 | 45.44 | 68.16 | 310.76 |
| WG-13 | 16500 | 21.00 | 38.93 | 58.40 | 263.89 |
| Mi-8 | 28660 | 34.93 | 38.67 | 58.01 | 438.94 |
| Mi-6 | 93700 | 57.41 | 42.54 | 63.81 | 721.43 |
| Mi-10 | 96340 | 57.41 | 43.13 | 64.70 | 721.43 |
| Mi-24 | 22000 | 27.87 | 42.46 | 63.69 | 350.22 |
| Mi-26 | 123450 | 52.50 | 53.39 | 80.09 | 659.73 |
| AL III | 4850 | 18.07 | 30.75 | 46.13 | 227.07 |
| BO-105 | 5732 | 16.14 | 37.42 | 56.13 | 202.82 |

A much smaller craft than the Mi-24 HIND is selected as a second example; the selection being the uH-1 Bell of Vietnam fame. Again from Jane's Gross weight=9,500 lb
Rotor radius=27.87 ft
Rotor Blade Tip Speed=682.9 ft/sec
From Equation 1 of FIG. 2, $V_z$=32.40 ft/sec
From the plot: $\rho d$ vs $V_z$ $V_z$=32.40 ft/sec
$\rho d$=0.044
From Equation 12

$$\frac{F}{A_c} = \frac{\rho V_z^2}{64.4} = \frac{\rho(682.9)^2}{2.(32.2)} \times \frac{2728}{144}$$

$$\frac{F}{A_c} = 466{,}352.4\rho \frac{\text{lb}_f}{\text{in}^2}$$

For demonstration purposes NYLON TM is selected as the material:

$$\rho_{NYLON} = .041 \times 1728 \times \frac{1}{32.2} = 2.2 \text{ slug/ft}^3$$

Therefore $$\frac{F}{A_c} = .041(466{,}352.4) = 3562.8 \frac{\text{lb}_f}{\text{in}^2}$$

From the plot:
$\rho d$=0.044
$\rho$=0.041 $\text{lb}_m/\text{in}^3$
Therefore $$d = \frac{.044}{2.2} = .01999 \text{ ft} \times 12 = .2399 \text{ inch}$$

$$A_c = \frac{\pi(.2399)^2}{4} = .0452 \text{ in}^2 \; F = 161.14 \text{ lb}_f$$

From materials characteristics, Tensile strength for NYLON is given as 143,000 (lb/in$^2$)
Therefore the break strength would equal 6,463.6 lb. Consequently $A_c$ can be reduced to a threshold where the tensile force equals 161.4 lb.
Therefore
$A_c$=0.0452 in$^2$ The break strength equals 6,463.6 lb. Consequently $A_c$ can be reduced to a threshold where the tensile force equals 161.4 lb. where $$A_c = \frac{161.4}{143{,}000} = .0011 \text{ in}^2$$

and $$d = \sqrt{(.0011)\frac{4}{\pi}} = .0032 \text{ ft}$$

checking the product $\rho d$
$\rho d$=2.2(0.0031)=0.0069
To insure that the condition stated by Equation 7 is satisfied:

$$\frac{.0000422(32.4)^2}{.0069} = 6.389$$

which is >1.
The parameters for a NYLON cable have been identified:
d=0.0031 ft=0.037 in
L=350 ft $$\text{Wt} = 350 \times \frac{\pi(.0031)^2}{4} \times .041 \text{ lb/in}^3 \times 1728 = 0.1872 \text{ lb}$$

The above method demonstrates that various materials can be selected depending upon design consideration such as:

cost
spectrum of potential targets
packaging constraints:
weight, volume, projectile dimensions.
operational environment:
cold, heat.

A launch system must now be considered. It is noted that the weights of cables required to practice the present invention are quite small in volume and under 1 lb in weight. For instance, the cable employed against the Hind craft above has a diameter of 0.07 in. and a length of 350.22 feet. Cross-sectional area
$\pi R^2$=0.003848 in.

Volume $=0.003848\times350.22\times12=16.17$ cubic inches; a space of approximately $2.5\times2.5\times2.5$ in$^3$. Such a cable together with a fuze and small explosive charge to deploy the cable may be readily accommodated in many different types of projectiles such as a mortar shell, rockets and various other projectiles. A mortar or rocket can be fired from ground-based launchers and rockets from airplanes or other helicopters. The projectile in conjunction with a timed or remote set fuze provides variable range airburst and thus rockets can be readily employed to cover a large target area and at different levels above the ground as well as the ground as described subsequently.

Figure 3:
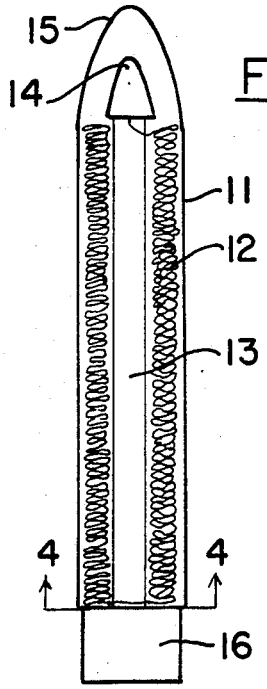
FIG. 3 is an illustration of a projectile for launching a cable.
Figure 4:
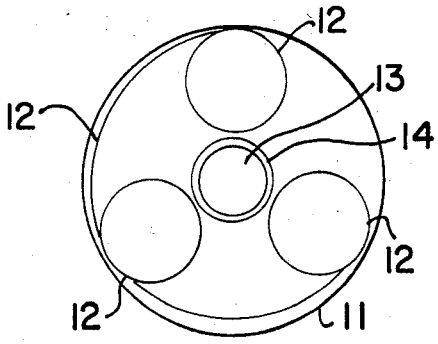
FIG. 4 is an internal view illustrating the interior arrangement of the cable in a projectile.

Referring now to FIGS. 3 and 4 of the accompanying drawings there is illustrated a proposed internal structure of a missile or mortar shell equipped with a cable according to the present invention.

A missile 11 has the forward upper portion of its outer shell removed to reveal a cable fan 12 folded relatively loosely in two or three stacks deployed about a hollow cylinder 13. Located at the end of the sleeve 13, at the top in FIG. 3, is an end cap 14 that is attached to one end of the cable 12 and is adapted to be propelled through the tapered end 15 of the outer casing of the missile when a fuze 16 ignites an explosive charge carried in the cylinder 13. Upon such occurrence the cable follows the member 14 in flight from the missile and is deployed.

Many other deployment schemes may be employed as well as launch vehicles. The launch vehicle does not require sophisticated hardware, can employ time fuzes and the simplest of mortar shells. As indicated above, even a cable for a large craft such as the Hind Mi24 requires a space in the neighborhood of 16 cubic inches. Other cable launch schemes are found in the patent literature and in my aforesaid prior patents.

The method of the invention may also be employed to define cables lying on the ground in a suspected landing area of helicopters. Due to the fine tuning of the physical characteristics of the cable to the specific helicopter, the cables or portions of cables lying just outside of the down wash of the rotor will be picked up and brought over the top rotor by the back flow into such region to replenish the air being forced down. In this case, however, the flow of air along the ground as it exits the region under the rotor helps pick up the cables and assists in the ingestion effect. More precisely stated, when a helicopter lands or is located just above the ground a vertical donut shaped region of air flow, shown in cross-section in FIG. 5, is established with the air flowing down under the rotor and back up to over the rotor just outside of the down wash from the rotor.

Figure 5:
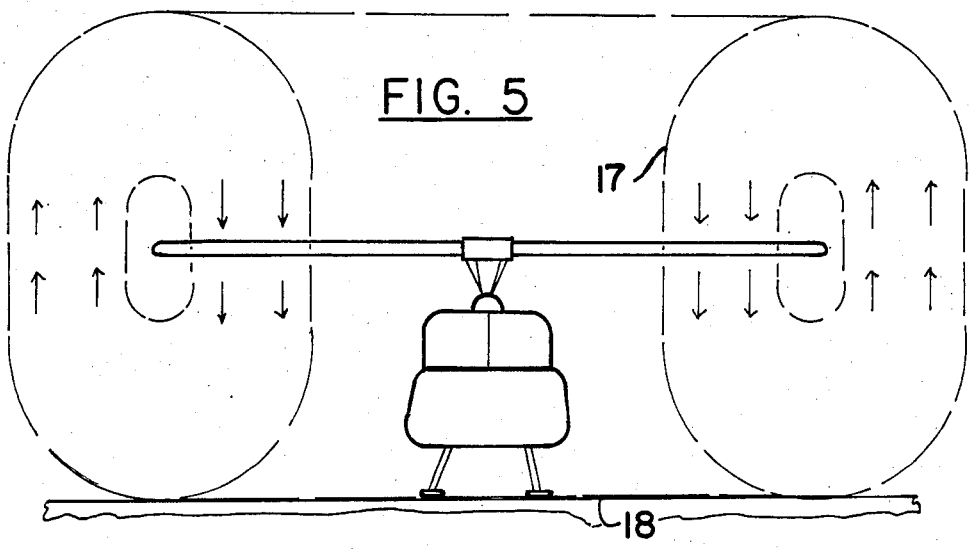
FIG. 5 is a diagrammatic view of the air flow around a landed helicopter or one closely approaching the ground.

Such a system is illustrated in FIG. 5 of the accompanying drawings wherein the donut 17 is representative of the airflow about the craft when in contact with or in close proximity to the ground. A cable 18 lying on the ground, if proportioned in accordance with the present invention will be picked up and be ingested into the rotors or at the least be whipped about sufficiently to kill emerging troops.

The cables may be laid as a grid by very low energy missiles from, for instance, a grenade launcher and/or may simply be those cables that were launched into the air, missed a target and fell to the ground.

Materials that may be employed in fabricating the cables have been given by tradenames. Materials such as found in U.S. Pat. Nos. 3,600,350; 3,975,331; 4,133,802; and 4,181,793 are employable in various of the cables.

The launch schemes and specific materials employed are secondary to the basic concept of the invention which is that proper selection of a cable for a specific craft results in maximum positive ingestion of the cable into the helicopter rotor and this together with the known ability to identify approaching helicopters by their beat frequencies defines a highly efficient, low cost helicopter destruction system.

Other improvements, modifications and embodiments will become apparent to one of ordinary skill in the art upon review of this disclosure. Such improvements, modifications, and embodiments are considered to be within the scope of this invention as defined by the following claims.

I claim:

1. A method of destroying flight vehicles having rotating blades and control mechanisms for such blades comprising the steps of launching a cable carrying projectile to deploy the cable into a position to be ingested into the rotating blades of the vehicle and selecting for transport by a projectile a cable having a product of $\rho_c d_c$ satisfying the equation $4.22\times10^{-5}V_z^2/\rho d\geqq1$ where $V_z$ is the rotor induced velocity of air of the vehicle to be destroyed and $\rho_c$ and $d_c$ are the density and diameter, respectively of the cable and having a length to become effectively entangled in the rotating blades and mechanisms and having the strength to survive ingestion.

2. The method of destroying a helicopter comprising identifying a helicopter by the audible beat frequency established between its main and tail rotors, selecting a projectile having a cable carried therein for launch by the projectile which cable conforms to the equation $4.22\times10^{-5}(V_z^2/\rho d)\geqq1$ where $V_z$ is the downward velocity of air induced by the helicopter's rotor, and $\rho$ and d are the density and diameter of the cable, respectively, and launching the projectile to deploy the cable above the helicopter, the cable having the strength to survive ingestion.

3. The method according to claim 2 wherein the projectile is aimed to deploy the cable above the helicopter by a distance in the approximate range of twice the diameter of the main rotor of the helicopter to just above the main rotor of the helicopter.

4. The method of destroying a helicopter comprising the steps of deploying cables in a location to be ingested into the rotor system of the helicopter, and selecting such cables such that they satisfy the equation $4.22\times10^{-5}V_z^2/\rho d\geqq1$ where $V_z$ is the rotor induced downward velocity of air at the tips of the rotor blades, $\rho$ is the density of the material of the cable and d is the diameter of the cable and having the strength to survive ingestion sufficiently to damage the rotor system and a length to become effectively entangled in same.

5. The method according to claim 1 or 2 or 4 wherein the cable launched has a length approximately equal to twice the span of the rotor blades.

6. An apparatus for destroying helicopters by producing entanglement of an operative mechanism of the craft by a cable comprising, means for deploying cables in a location such as to have a probability of being ingested into an operating mechanism of the craft by the air flow produced by the rotors of the craft, said cable satisfying the equation $$4.22\times10^{-5}V_z^2/\rho d \geqq 1$$

where $V_z$ is the rotor induced downward velocity of air, $\rho$ is the density of the cable and d is the diameter of the cable, and having the strength to survive ingestion sufficiently to damage said helicopter's flight ability.

7. An apparatus according to claim 6 wherein said cable has a length equal to or greater than twice the span of the rotor blades of the target helicopter.

* * * * *